US007980028B1

(12) United States Patent
Kunz

(10) Patent No.: US 7,980,028 B1
(45) Date of Patent: Jul. 19, 2011

(54) COIL SPRING COUNTERBALANCE SYSTEM FOR SIDE LOADING WINDOW SASHES

(76) Inventor: John R. Kunz, Douglassville, PA (US)

( * ) Notice: Subject to any disclaimer, the term of this patent is extended or adjusted under 35 U.S.C. 154(b) by 718 days.

(21) Appl. No.: 11/827,968

(22) Filed: Jul. 16, 2007

(51) Int. Cl.
*E05F 3/00* (2006.01)

(52) U.S. Cl. ..... 49/447; 49/445; 16/197; 16/401

(58) Field of Classification Search ..... 49/445, 49/447, 453, 454; 16/193, 197, 401
See application file for complete search history.

(56) References Cited

U.S. PATENT DOCUMENTS

| | | | | | |
|---|---|---|---|---|---|
| 2,635,282 | A * | 4/1953 | Trammell, Sr. et al. | ..... | 16/197 |
| 2,644,193 | A * | 7/1953 | Anderberg | ..... | 16/197 |
| 2,732,594 | A | 1/1956 | Adams et al. | ..... | 20/52 |
| 3,086,259 | A * | 4/1963 | Klein | ..... | 49/415 |
| 3,160,914 | A | 12/1964 | Brienza | ..... | 16/206 |
| 4,089,085 | A | 5/1978 | Fitzgibbon | ..... | 16/197 |
| 4,697,304 | A | 10/1987 | Overgard | ..... | 16/198 |
| 4,935,987 | A * | 6/1990 | Sterner, Jr. | ..... | 16/198 |
| 5,207,025 | A * | 5/1993 | Westfall | ..... | 49/445 |
| 5,231,795 | A * | 8/1993 | Westfall | ..... | 49/446 |
| 5,353,548 | A * | 10/1994 | Westfall | ..... | 49/446 |
| 5,463,793 | A * | 11/1995 | Westfall | ..... | 16/197 |
| 6,393,661 | B1 * | 5/2002 | Braid et al. | ..... | 16/197 |
| 6,745,433 | B2 | 6/2004 | Newman et al. | ..... | 16/207 |
| 6,860,066 | B2 * | 3/2005 | Kunz et al. | ..... | 49/181 |
| 7,036,275 | B2 * | 5/2006 | Quesada | ..... | 49/446 |
| 2008/0178424 | A1 * | 7/2008 | Tuller | ..... | 16/193 |

* cited by examiner

*Primary Examiner* — Jerry Redman
(74) *Attorney, Agent, or Firm* — LaMork & Associates, P.C.

(57) ABSTRACT

A counterbalance system for a side load window assembly having a window sash and side frame jambs. A spring carriage is provided. The spring carriage has a first section that fits into a gap space between the window frame and the window sash. The spring carriage also includes a second section that passes under the window sash, therein supporting the window sash. At least one coil spring is provided. Each coil spring has a wound body that is held within the spring carriage. Each coil spring also has a first end that extends out of a housing and is anchored to one of the side frame jambs. The coil springs bias the spring housing upwardly. Since the window sash rests upon the housing, the window sash is counterbalanced.

7 Claims, 4 Drawing Sheets

COIL SPRING COUNTERBALANCE SYSTEM FOR SIDE LOADING WINDOW SASHES

BACKGROUND OF THE INVENTION

1. Field of the Invention

In general, the present invention relates to counterbalance systems that are used to hold the sashes of a window open. More particularly, the present invention relates to counterbalance systems that are used in window assemblies having side loading sashes.

2. Prior Art Description

There are many types of windows used in modern construction. Some windows are designed to open, some are not. Of the windows that are designed to open, some windows have sashes that open vertically and others have sashes that slide open laterally, or rotate outwardly.

Windows that have vertically opening sashes are the most common window used in residential home construction. Vertically opening windows are either single-hung, having one sash that opens, or double-hung, having two sashes that open. In both single-hung and double-hung windows, the same system is used to hold a window sash up once it is open. If no system is used, gravity causes the sash of the window to close as soon as it is opened and released.

In low quality windows, friction between the window sash and the window frame is relied upon to hold a sash open. Such a system is highly unreliable because the friction relied upon varies as parts wear, expand, contract and are painted. It is for this reason that most single and double-hung windows are manufactured with counterbalance systems.

Early window sash counterbalance systems were simply weights that were attached to the sash. The weights were attached to a sash by a rope or chain that passed over a pulley at the top of the window frame. Such old counterbalance systems are exemplified by U.S. Pat. No. 3,160,914 to Brienza, entitled Sash Weight Mounting Means. Such counterbalance systems required window wells in which the weights move. Accordingly, such windows were difficult to insulate. Additionally, the rough opening needed for the window had to be much larger than the window sashes. Finally, window sashes attached to such counterbalance systems could not be tilted for cleaning or otherwise removed from the window frame.

Recognizing the many disadvantages of window well counterbalance systems, windows were manufactured with spring loaded counterbalance systems. Spring loaded counterbalance systems relied upon the pulling strength of a spring, rather than a hanging weight, to counterbalance the weight of a window sash. Accordingly, window wells for weights were no longer required.

Counterbalancing a window sash with a coil spring is a fairly simple matter. One end of the coil spring is attached to the window frame while the body of the coil spring is engaged by the sash. One of the simplest examples of a coil spring counterbalance system is shown in U.S. Pat. No. 2,732,594 to Adams, entitled Double Hung Window Sash. The difficulties with such a system occur when a window manufacturer wants to use coil springs to counterbalance a window sash while simultaneously making a window tiltable or removable for cleaning.

In modern tilt-in windows, the window sash tilts for cleaning but never completely leaves the window frame. Counterbalancing such windows can, therefore, be accomplished by attaching coil springs to the end of the window sash that never leaves the frame.

Counterbalancing a window with a sash that is removable is far more difficult. In a window with a removable sash, the counterbalance system must have the ability to connect and disconnect from the sash. The counterbalance system commonly used for a side loading window with a removable sash is a "block and tackle" counterbalance. A block and tackle counterbalance contains pulleys, string and a spring that maintains tension on the string. The end of the string is typically attached to the window sash with a clip. When a window sash is being removed completely from a window frame, the clip must be manually detached from the sash. Once detached, the sash can be removed while the block and tackle counterbalance system remains behind in the jamb of the window frame. Prior art block and tackle counterbalance systems are exemplified in U.S. Pat. No. 6,745,433 to Newman, entitled Side Load Balance Cord Terminal Clip; U.S. Pat. No. 4,697,304 to Overgard, entitled Friction Controlled Window Balance, and U.S. Pat. No. 4,089,085 to Fitzgibbon, entitled Sash Balance and Components Thereof.

There are many problems associated with prior art block and tackle counterbalance systems. First, a block and tackle counterbalance system must be custom designed to correspond to a particular window sash height and/or weight. Different block and tackle counterbalance assemblies must therefore be manufactured to accommodate sashes of different sizes and different weights. Furthermore, block and tackle counterbalance systems are complex assemblies that contain several moving parts. These parts are difficult to assemble and are subject to failure over time. Consequently, block and tackle counterbalance systems tend to be expensive to manufacture and have limited reliability. Another disadvantage of block and tackle counterweight assemblies is that they are difficult to detach and reattach to a window sash and can easily cause injury to an inexperienced person who attempts the task.

A need therefore exists for a counterbalance system that can be used in a window assembly with a side loading sash, wherein the counterbalance system does not use a complex block and tackle construction, is versatile to many window sizes, is simple to attach and detach, and is both simple and inexpensive to manufacture. This need is met by the present invention as described and claimed below.

SUMMARY OF THE INVENTION

The present invention is a counterbalance system for a side load window assembly. The side load window assembly has a window frame with side jambs. At least one window sash is held in the window frame, wherein the window sash is free to be selectively opened and closed. The window sash has a top, a bottom and two vertical sides. When the sash is installed into the window frame, it assumes an operable position where the vertical sides of the window sash are aligned with the side jambs of the window frame. When the sash is in its operational position, a gap space exists between the vertical sides of the window sash and the side jambs of the window frame. This gap space is utilized by the counterbalance system.

The counterbalance system includes a housing. The housing has a first section that fits into the gap space between the window frame and the window sash. The housing also includes a second section that passes under a portion of the bottom of the window sash, therein supporting the window sash when the window sash is in its operable position.

At least one coil spring is provided. Each coil spring has a wound body that is held within the confines of the housing. Each coil spring also has a first end that extends out of the housing. The first end of each coil spring is anchored to one of the side jambs of the window frame.

The coil springs bias the housing upwardly. Since the window sash rests upon the housing, the window sash is counterbalanced. The window sash only rests upon the housing and can be lifted away from the housing. Consequently, the counterbalance system provides a counterbalancing force for a window sash without inhibiting the window sash from being removed from the window assembly.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention counterbalance system can be used to counterbalance the sashes in a double-hung window, the exemplary embodiment selected for illustration shows a single-hung window. The choice of a single-hung window was made simply for ease of illustration purposes and should not be considered a limitation upon the invention as claimed.

Figure 1:
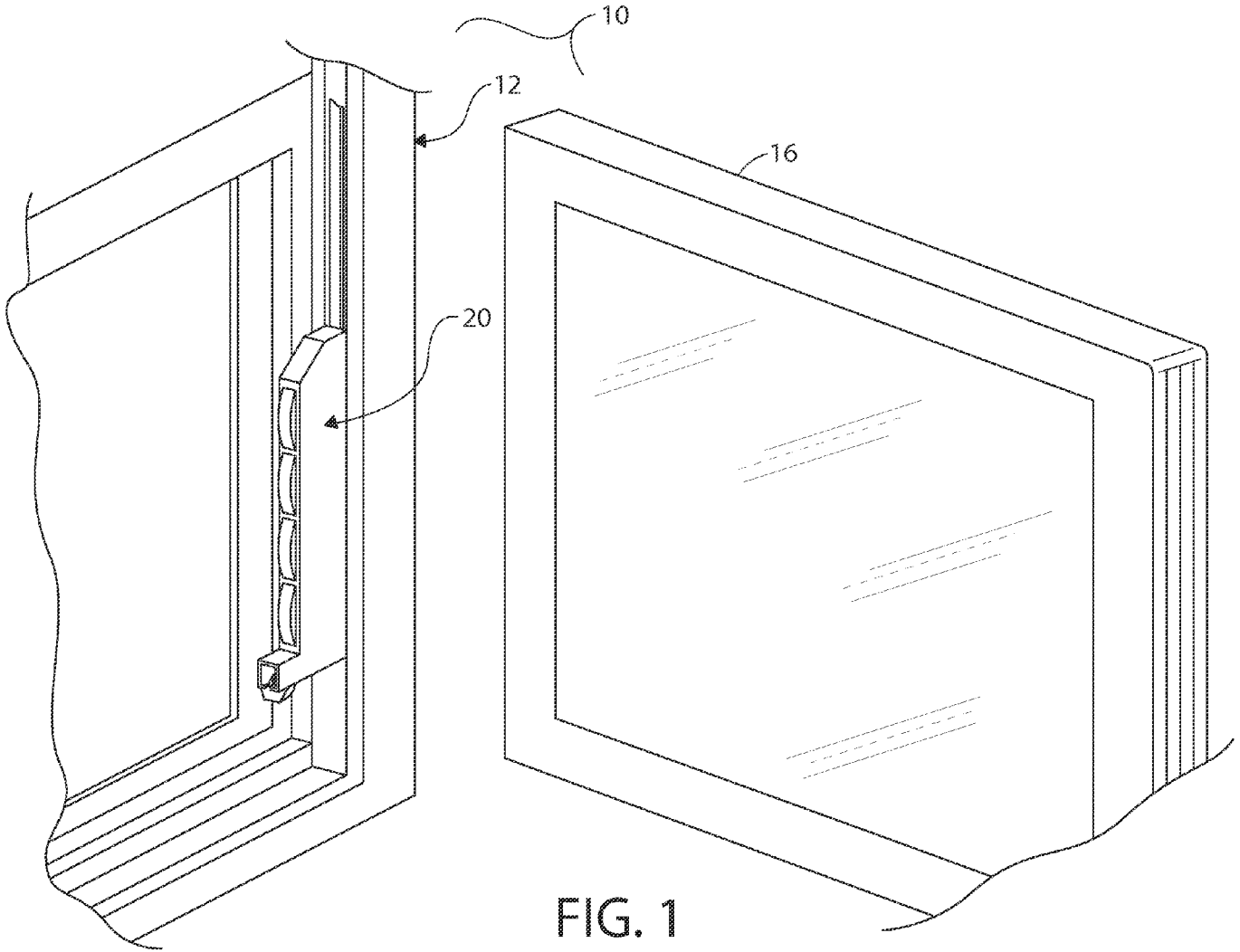
FIG. 1 is a perspective view of an exemplary embodiment of a side load window assembly containing a counterbalance system.
Figure 2:
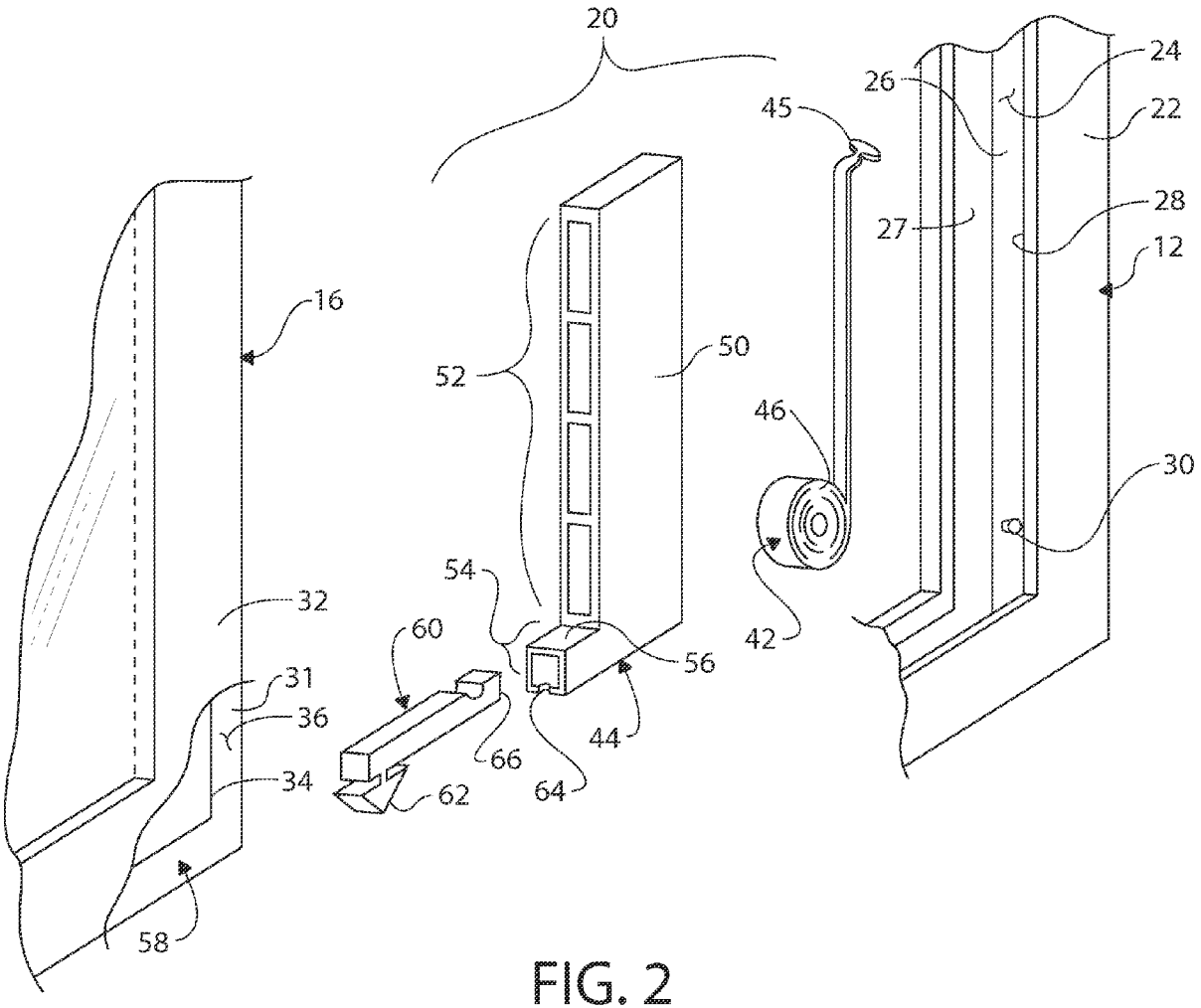
FIG. 2 is an exploded view of the counterbalance system shown utilized in FIG. 1.

Referring to both FIG. 1 and FIG. 2, there is shown a window assembly 10. The window assembly 10 has a window frame 12 that retains both an upper sash (not shown) and a lower sash 16. As has been previously stated, the window assembly 10 is being illustrated as a single-hung window, meaning that only the lower sash 16 can be opened.

The window assembly 10 is constructed to be a "side load" window. A side load window is a common window type where one or more of the sashes can be selectively removed from the window frame. For a variety of reasons, side load windows are commonly used in the construction of many types of replacement windows.

In a side load window, a sash can be completely removed. In the shown exemplary embodiment, the lower sash 16 has side load features and is removable. Depending upon the size of the window assembly 10, the window sash 16 may have a weight of between five pounds and fifty pounds. Furthermore, the window sash 16 may have a length and height that varies between one foot and three feet.

When the window sash 16 is loaded into the window frame 12, it enters its operable position. In its operable position, the window sash 16 can be selectively opened and closed by being slid up and down. To prevent the window sash 16 from closing under the force of its own weight, it must be counterbalanced. A counterbalance system 20 is provided to retain the window sash 16 in an open position. The counterbalance system 20 is especially designed for side load windows. Furthermore, the counterbalance system 20 is highly versatile, wherein a single counterbalance system can be adapted for use in window assemblies having sashes in a wide variety of sizes and weights.

Figure 3:
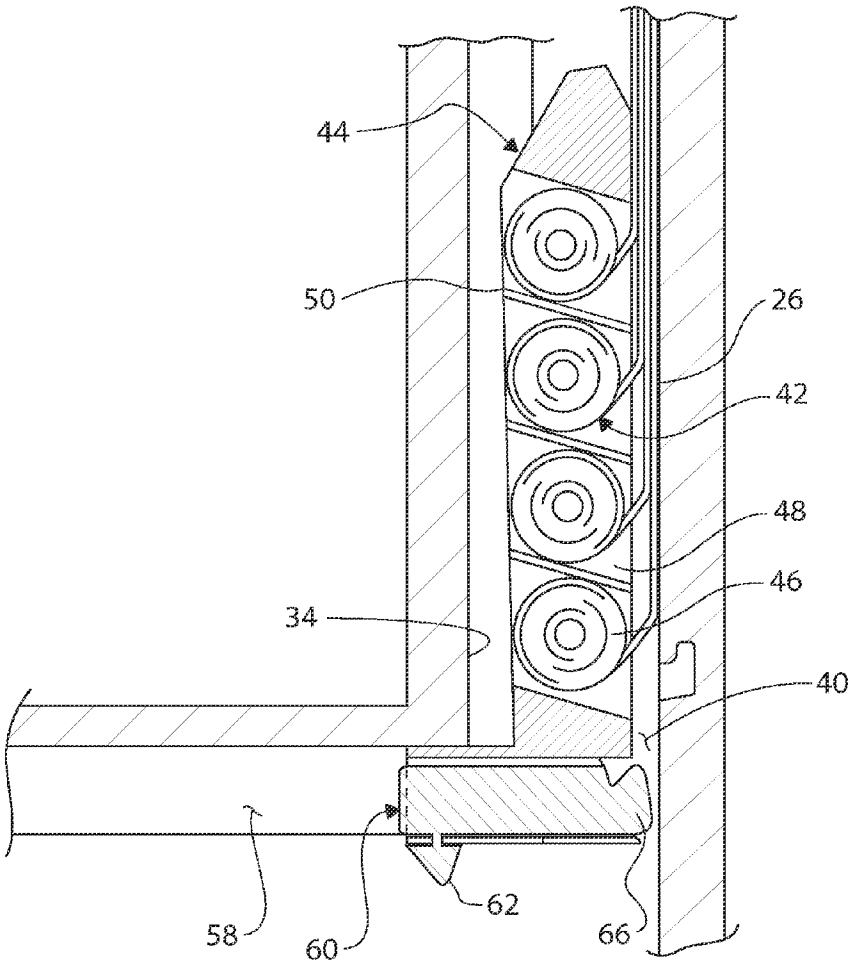
FIG. 3 is a cross-sectional view of the counterbalance system shown unlocked and with the window sash in its operational position.
Figure 4:
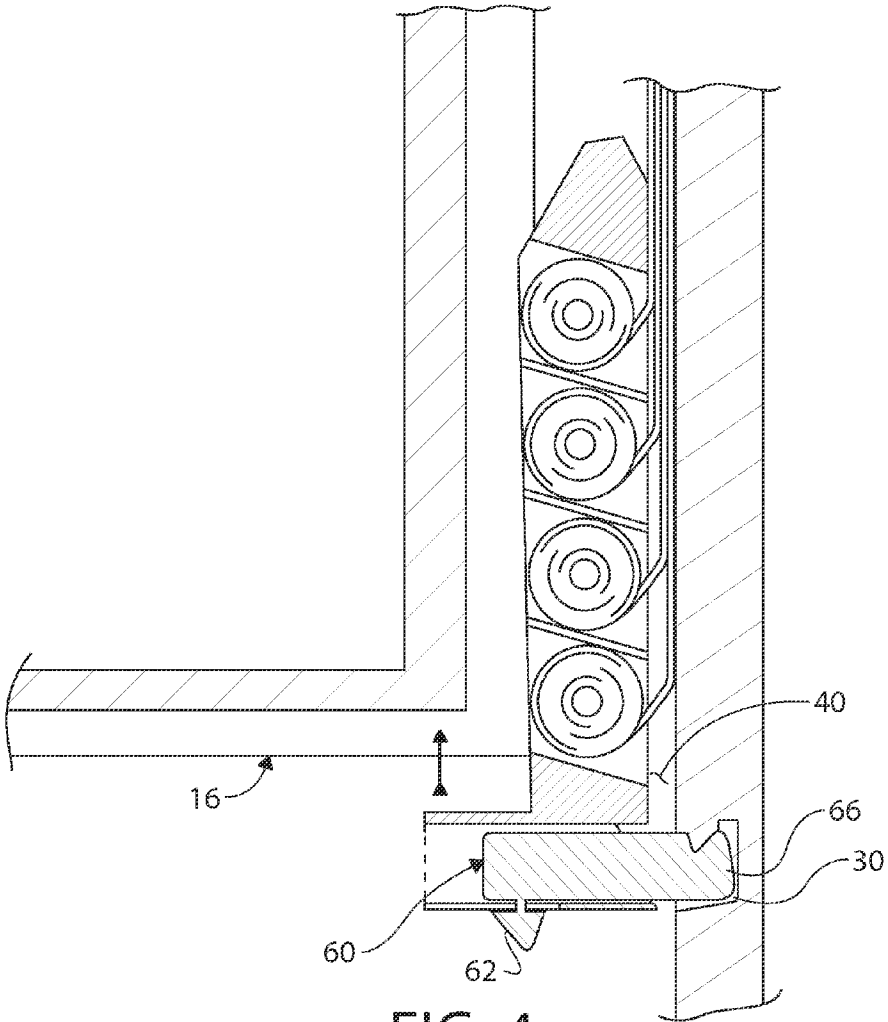
FIG. 4 is a cross-sectional view of the counterbalance system shown in a locked condition and with the window sash being removed.

Referring to FIG. 2 in conjunction with both FIG. 3 and FIG. 4, it can be seen that the window frame 12 has side jambs 22. Each of the side jambs 22 defines a primary channel 24 in which the window sash 16 rides. Each primary channel 24 is defined by a back surface 26 that lay perpendicular to the plane of the window sash 16 and two side surfaces 27, 28 that lay in planes parallel to the plane of the window sash 16. A locking depression 30 is formed in the back surface 26 of the primary channel 24 at a predetermined position. The purpose of the locking depression 30 is later described.

The window sash 16 has a width that is sized to pass into the primary channel 24 of the side jamb 22. The window sash 16, therefore, rides within the primary channel 24 as it moves up and down. The front and rear surface 31, 32 of the window sash 16 extend beyond the vertical sides 34 of the window sash 16. This creates a secondary channel 36 along the sides 34 of the window sash 16. When the window sash 16 is installed into the window frame 12, the secondary channel 36 along the window sash 16 faces the primary channel 24 along the side jamb 22. This creates a gap space 40 between the window sash 16 and the side jamb 22. The gap space 40 is utilized to hold the counterbalance system 20, as is explained below.

The counterbalance system 20 relies upon coil springs 42 to counteract the weight of the window sash 16. However, the coil springs 42 are not directly attached to the window sash 16. Rather, the counterbalance system 20 utilizes a spring carriage 44 that holds the wound body 46 of the coil spring 42. The spring carriage 44 extends into the gap space 40 between the side jamb 22 and the window sash 16. The spring carriage 44 supports the weight of the window sash 16 and transfers that weight to the coil springs 42.

The spring carriage 44 includes a housing 50. The housing 50 has a top section 52 and a base section 54. The top section 52 is narrow and is sized to fit into the gap space 40 that exists between the side jamb 22 and the window sash 16. The base section 54 of the housing 50, however, is elongated, therein creating a lateral sill 56 that passes under the bottom of the window sash 16. The window sash 16 rests upon the lateral sill 56, whereby the lateral sill 56 supports the weight of the window sash 16.

A bottom groove 58 is present on the bottom of the window sash 16. The bottom groove 58 receives the lateral sill 56 extending from the spring carriage housing 50. Only gravity holds the window sash 16 in place upon the lateral sill 56 of the spring carriage housing 50. It will therefore be understood that the window sash 16 can be lifted upwardly off the lateral sill 56.

The spring carriage 44 defines at least one spring compartment 48. In the shown embodiment, pluralities of spring compartments 48 are shown. Each of the spring compartments 48 holds the wound body 46 of a coil spring 42. Each coil spring 42 has a free end 45. The free end 45 of each coil spring 42 extends out of the housing 50 and up the back surface 26 of the primary channel 24 in the side jamb 22. The number of coil springs 42 that are used is dependent upon the weight of the window sash 16. For example, if each coil spring 42 provides a counterbalance force of five pounds, and a window sash 16 weighs twenty pounds, then a total of four coil springs 42 would be used, two on each side of the window sash 16.

The free ends 45 of the coil springs 42 are anchored to the back surface 26 of the primary channel 24 at some high point along the side jamb 22. Accordingly, as each coil spring 42 unwinds, the natural curvature associated with the coil spring 42 causes the unwound sections of the coil spring 42 to press against the back surface 26 of the primary channel 24. The unwound sections of the coil springs 42 are therefore kept flush against the back surface 26 of the primary channel 24. The coil springs 42 provide an upward bias to the window sash 16 that counterbalances its weight. Accordingly, the window sash 16 will stay in position once opened.

A slide lock 60 is disposed in the base section 54 of the spring carriage 44. The slide lock 60 can move back and forth in the horizontal plane. When the window sash 16 is installed in the window frame 12, the slide lock 60 does nothing. The slide lock 60 is retracted into the base section 54 of the spring carriage 44 and does not effect the movement of either the window sash 16 or the spring carriage 44.

The slide lock 60 has a knob 62 that extends below the spring carriage 44 through a slot 64. The knob 62 enables a person to selectively move the slide lock 60 back and forth using manual force. When the knob 62 is manually moved in one direction (to the right in the illustration), the distal end 66 of the slide lock 60 extends laterally out of the spring carriage 44. When the window sash 16 is opened to a predetermined height, the slide lock 60 can be made to align with the locking depression 30 in the back surface 26 of the primary channel 24. Once aligned, the distal end 66 of the slide lock 60 can be caused to pass into the locking depression 30.

When the slide lock 60 enters the locking depression 30 in the primary channel 24 of the side jamb 22, the spring carriage 44 becomes mechanically interconnected to the side jamb 22. Accordingly, the spring carriage 44 can no longer be moved. Once the spring carriage 44 is locked in a fixed position, the window sash 16 can be lifted away from the spring carriage 44. Once lifted to a height where the window sash 16 is free of the spring carriage 44, the window sash 16 can be removed from the window assembly 10.

Each spring carriage 44 used in the present invention counterbalance system 20 can hold between one and four coil springs 42. It will therefore be understood that the counterbalance system 20 can be adapted for use with many different sizes and weights of windows sashes. Heavy window sashes require more coil springs, lighter window sashes require less. Regardless, the spring carriage 44 and the engagement between the window sash 16 and the spring carriage 44 remain the same. A single, low-cost spring carriage 44, in combination with varying numbers of coil springs 42 can therefore be used to counterbalance most any window assembly having jambs and window sashes configured for side loading.

It will be understood that the embodiment of the present invention that is described and illustrated is merely exemplary and that a person skilled in the art can make many variations to the invention using functionally equivalent components. For instance, the slide lock can be configured as a bolt pin. The spring carriage can be configured to hold only one, two or three coil springs, rather than the four illustrated. All such variations, modifications and alternate embodiments are intended to be included within the scope of the present invention as defined by the claims.

What is claimed is:

1. A side load window assembly, comprising:

a window frame having side jambs, wherein a locking depression is formed in each of said side jambs;

a window sash having a top, a bottom and two vertical sides, said window sash being selectively positionable into an operable position where said vertical sides of said window sash are aligned with said side jambs of said window frame, and wherein a gap space exists between said vertical sides of said window sash and said side jambs of said window frame when said window sash is in said operable position;

a slide lock;

a spring carriage having a top section and a base section integrally formed as a single piece, wherein said top section is sized to fit into said gap space between said window frame and said window sash, and wherein said base section is elongated and creates a lateral sill that passes under a portion of said bottom of said window sash, therein supporting said window sash when said window sash is in said operable position;

wherein said top section of said spring carriage defines at least one spring compartment; and wherein said bottom section of said spring carriage defines a compartment under said lateral sill that receives said slide lock, therein enabling said slide lock to selectively move back and forth between a retracted position and an extended position;

wherein when said slide lock engages said locking depression in said side jamb when moved to said position as said window sash is opened to a predetermined height, therein mechanically interconnecting said carriage housing to said side jamb;

a coil spring retained in each spring compartment of said spring carriage, wherein each said coil spring has a first end extending from said spring carriage, wherein said first end of each said coil spring is anchored to one of said side jambs of said window frame.

2. The assembly according to claim 1, wherein said window sash is separable from said spring carriage by lifting said window sash up and off said second section of said spring carriage.

3. The assembly according to claim 2, wherein said window sash is free of said side jambs once separated from said spring carriage.

4. In a window assembly having a window sash positioned between two window frame jambs, wherein a gap space exists between said window sash and said window frame jambs, a counterbalance system for said window sash comprising:

a spring carriage having a top section and a base section integrally formed as a single piece, wherein said top section is sized to fit into said gap space between said window frame jambs and said window sash, and wherein said base section is elongated and creates a lateral sill upon which part of said window sash rests when positioned between said two window frame jambs;

wherein said top section of said spring carriage defines a spring compartment;

a coil spring having a wound body from which a first end of said coil spring can be drawn, said wound body being carried by said spring compartment of said spring carriage in said gap space between said window sash and said window frame jambs, wherein said first end of said coil spring is anchored to one of said window frame jambs.

5. The system according to claim 4, further including a locking mechanism for selectively connecting said spring carriage to one of said window frame jambs in a fixed position.

6. The system according to claim 5, wherein said locking mechanism includes a slide lock that extends from said spring carriage and engages one of said window frame jambs.

7. The system according to claim 5, wherein said spring carriage defines multiple spring compartments and multiple wound bodies of coil springs are retained by said spring carriage.

* * * * *